United States Patent [19]

Busbach

[11] 3,945,515

[45] Mar. 23, 1976

[54] ARRANGEMENT FOR PREVENTING THE ESCAPE OF DUST AND GAS DURING THE FILLING OF A FURNACE

[75] Inventor: Willi Busbach, Essen, Germany

[73] Assignee: Bergwerksverband GmbH, Essen, Germany

[22] Filed: July 17, 1974

[21] Appl. No.: 489,420

[30] Foreign Application Priority Data

July 18, 1973 Germany ..... 2336514

[52] U.S. Cl. ..... 214/35 R; 202/262; 214/18 PH

[51] Int. Cl.[2] ..... F23K 3/00

[58] Field of Search ..... 214/18 PH, 35 R; 202/262, 202/263

[56] References Cited

UNITED STATES PATENTS

| | | | |
|---|---|---|---|
| 1,597,314 | 8/1926 | Howard et al. | 214/18 PH |
| 3,435,968 | 4/1969 | Tagiri et al. | 214/35 R |
| 3,675,797 | 7/1972 | Pries | 214/35 R |

*Primary Examiner*—Robert G. Sheridan
*Attorney, Agent, or Firm*—Michael J. Striker

[57] ABSTRACT

A furnace has a normally closed filling inlet. There is provided an arrangement for opening the filling inlet, then filling the interior of the furnace with a charge, and then reclosing the inlet, all in gas-tight and dust-tight manner, in order to prevent the free escape of dust and gases into the ambient atmosphere during the filling of the furnace. The arrangement includes a housing having an opening positioned in proximity to the normally closed filling inlet. A sealing arrangement is activatable for establishing a gas-tight and dust-tight seal between the portion of the housing surrounding the housing opening and the portion of the furnace surrounding the normally closed filling inlet, so as to confine within the interior of the housing any dust and gas entering the filling inlet or escaping from the filling inlet during the filling of the interior of the furnace. Inside the housing there is provided an arrangement activatable for opening and closing the normally closed filling inlet of the furnace. A filling arrangement is operative for conveying a charge through the interior of the housing and into the furnace filling inlet. The filling arrangement has a discharge end portion located within the housing gas-tightly and dust-tightly connected to the housing so that dust and gas leaving the discharge end portion but not entering the filling inlet is confined within the housing and is unable to freely escape into the ambient atmosphere. Advantageously, the arrangement is used in conjunction with a battery of furnaces having respective filling inlets arranged in a row, and the arrangement, as a whole, is movable into sealing engagement with successive ones of the filling inlets for filling successive ones of the furnaces.

9 Claims, 1 Drawing Figure

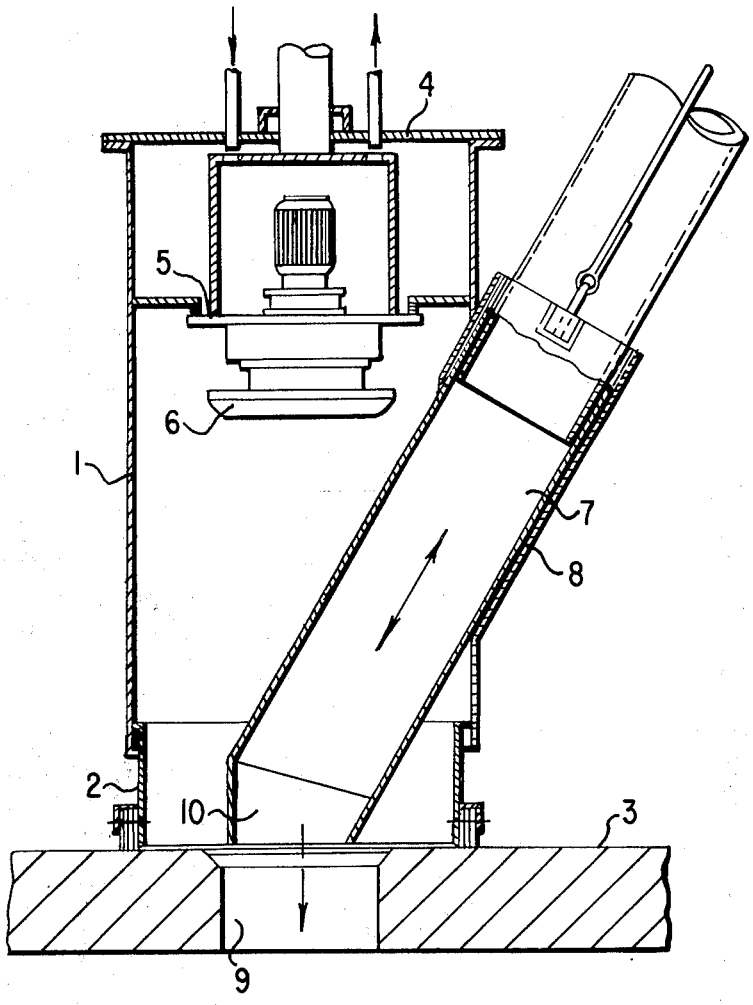
4
5
6
1
7
8
2
10
3
9

ARRANGEMENT FOR PREVENTING THE ESCAPE OF DUST AND GAS DURING THE FILLING OF A FURNACE

BACKGROUND OF THE INVENTION

The invention relates broadly to the problem of filling a furnace without permitting gas and dust to escape freely into the ambient atmosphere.

More specifically, the invention relates to the problem of lifting off the cover of a furnace opening, filling the interior of the furnace with a charge of moist or preheated coal, and then replacing the cover, without permitting gas and dust to escape freely into the ambient atmosphere.

Still more specifically, the invention relates to the problem of lifting off the covers, charging and then reclosing successive ones of the furnaces in a battery of furnaces, without permitting gas and dust to escape freely into the ambient atmosphere.

When filling the successive furnace chambers of a battery of coke furnaces with preheated coal, a great amount of gas and dust escapes into the atmosphere. This escape of dust and gas is environmentally detrimental and presents a serious health hazard to persons working in the vicinity of such a battery of coke furnaces. The known arrangements for counteracting this escape of dust and gas, such as those incorporating steam jet nozzles in the furnace feed pipe and those incorporating suction ventilating devices, have not proved completely satisfactory.

West German patent application Ser. No. 2,060,677 discloses an arrangement for charging coke ovens with dry, sometimes preheated coal. This arrangement constitutes an improvement over prior arrangements, in so far as the undesired release of dust and gas during the charging operation is concerned. However, this known arrangement has the disadvantage that it cannot prevent the escape of a very considerable amount of dust and gas during the time interval between the completion of the filling operation and the reclosing of the furnace filling inlet.

SUMMARY OF THE INVENTION

It is accordingly an object of the invention to provide an arrangement for opening the filling inlet of a furnace, filling the interior of the furnace with a charge and then reclosing the filling inlet of the furnace, without permitting the escape of dust and gas.

This object, and others which will become more understandable from the description, below, of a preferred embodiment, can be met, according to one advantageous concept of the invention, by providing, in combination with a furnace having a normally closed furnace filling inlet, an arrangement for opening the filling inlet, then filling the interior of the furnace and then reclosing the inlet all in gas-tight and dust-tight manner in order to prevent the free escape of dust and gas during the filling of the furnace. The arrangement advantageously comprises a housing having an opening positioned in proximity to the normally closed filling inlet of the furnace. Sealing means is activatable for establishing a gas-tight and dust-tight seal between the portion of the housing surrounding the housing opening and the portion of the furnace surrounding the normally closed furnace filling inlet, in order to confine within the interior of the housing any dust and gas entering the filling inlet or escaping from the filling inlet during the filling of the interior of the furnace. Means is provided within the housing activatable for opening and reclosing the normally closed furnace filling inlet. Filling means is operative for conveying a charge through the interior of the housing and into the furnace filling inlet. The filling means has a discharge end portion located within the housing gas-tightly and dust-tightly connected to the housing so that dust and gas leaving the discharge end portion but not entering the filling inlet are confined within the housing and are unable to freely escape into the ambient atmosphere. Advantageously, means can be provided for ventilating the interior of the housing prior to termination of the gas-tight and dust-tight seal established by the sealing means. Advantageously, the arrangement cooperates with a battery of furnaces having respective filling inlets arranged in a row, the arrangement being moved, as a whole, along such row, and serving to open, charge and reclose each furnace in turn, in a manner preventing the free escape into the ambient atmosphere of dust and gas.

Advantageously, the housing can be a generally tubular housing gas-tightly and dust-tightly sealed at its top by means of a removable cover member and having a lower open end. Provided at the lower open end is a telescoping sealing arrangement which can be telescoped out into engagement with the surface portion of the furnace wall surrounding the furnace filling inlet to form a gas-tight and dust-tight chamber into which the furnace inlet opens. The furnace inlet is normally provided with a removable cover. Accordingly, there is provided inside the housing of the arrangement an electromagnetic lifting arrangement which descends to electromagnetically engage and then lift off the furnace cover during the filling of the furnace. For the filling of the furnace, a telescopic filling pipe arrangement moves into working position, with its discharge end portion in proximity to the filling inlet of the furnace. Upon completion of the filling operation, the filling pipe arrangement is telescopically retracted, and then the electromagnetic lifting arrangement descends to replace the furnace cover and then rises in deenergized state to its retracted position. The housing is provided with a guide portion defining a guide opening for guiding the movement of the telescopically retractable filling pipe arrangement. The peripheral clearance defined between the filling pipe arrangement and the guide opening is gas-tightly and dust-tightly sealed, so that during and after the filling operation dust and gas cannot escape from the interior of the housing, until such time as the telescopically retractable sealing arrangement is retracted. However, before such retraction occurs, the interior of the housing will have been vented, so that no escape of injurious dust and gas into the ambient atmosphere will occur. The infeed end of the telescopically retractable filling pipe arrangement receives preheated or moist coal from a conveyor arrangement, for example a hopper car, a belt-type conveyor arrangement, a drag-link conveyor, or a screw conveyor.

The advantage of the invention resides not only in the fact that the filling operation can be performed without any escape of gas or dust into the atmosphere, particularly during the interval between the termination of filling and the closing of the furnace filling inlet, but additionally in the fact that the inventive arrangement prevents the free entrance of ambient air into the furnace chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE depicts in schematic manner one embodiment of the invention.

DESCRIPTION OF THE PREFERRED EMBODIMENTS

The arrangement includes a generally tubular body 1 provided at its lower end with a telescopic extension 2. The telescopic extension 2 can be lowered into gas-tight engagement with the upper surface of an upper furnace wall 3. The telescopic extension 2 can be raised and lowered by means of non-illustrated hydraulic cylinder-and-piston units of per se conventional construction, or by other conventional means.

When the telescopic extension 2 is lowered into engagement with the upper surface of the upper furnace wall 3, the seal-tight engagement between the extension 2 and the wall 3 is both gas-tight and dust-tight. This can be accomplished by providing the lower peripheral end face of the telescopic extension 2 with conventional sealing members.

The upper end of the tubular body 1 is sealed off by means of a removable cover portion 4.

Provided in the upper portion of the interior of the tubular body 1 is a schematically depicted electromagnetic lifting arrangement 5. The electromagnetic lifting arrangement 5 is operative for lifting the furnace cover 6 off the upper furnace wall 3 thereby opening the furnace filling inlet 9, and is operative for subsequently lowering the furnace cover 6 back into place thereby closing off the furnace filling inlet 9. When the furnace cover 6 is thusly replaced, the electromagnetic lifting arrangement 5 is deenergized, so that when it is subsequently raised, the furnace cover 6 remains in place, closing off the inlet 9. The electromagnetic lifting arrangement 5 can be raised and lowered by means of a conventional hydraulic cylinder-and-piston arrangement, the piston of which is shown rigidly connected to the housing which encloses the electromagnet of the lifting arrangement 5.

The arrangement shown in the FIGURE is further comprised of a filling pipe 7 slidable within a guide pipe 8 rigid or integral with the tubular body 1 and disposed at an angle relative to the tubular body 1. The filling pipe 7, in the illustrated embodiment, is composed of telescoped sections, of which only two are shown. The outermost one of the telescoped filling pipe sections is connected by means of the illustrated pulling cable to the piston of a non-illustrated hydraulic cylinder-and-piston arrangement of per se conventional construction. The cylinder-and-piston arrangement is operative for pulling upwardly on the pulling cable to effect retraction of the telescoped sections of the filling pipe 7. When the cylinder-and-piston arrangement is released, the filling pipe 7 sections lower under their own weight, being guided by the housing section 8.

The lowermost section of the telescoped filling pipe 7 is narrowed at its lower end, having an end section a portion of which is substantially vertical. The filling pipe 7 is gas-tightly and dust-tightly sealed relative to the cylindrical guide section 8 of the housing, by conventional sealing means.

The operation of the illustrated arrangement is as follows:

Initially, the filling pipe 7 is in its upwardly retracted position, the electromagnetic lifting arrangement 5 is in the illustrated upwardly retracted position, the telescoped lower extension 2 is in its upwardly retracted position, and the furnace cover 6 is in place closing off the furnace filling inlet 9.

The telescoped extension 2 of the housing 1 is then lowered into gas-tight and dust-tight engagement with the upper furnace 3 of the furnace, by hydraulic means for example. Next, the electromagnet arrangement 5, preferably in unenergized condition, is lowered, for example by hydraulic means, into engagement with the furnace cover 6. The electromagnet lifting arrangement 5 is then energized, causing the furnace cover 6 to be magnetically attracted thereto. Next, for example by hydraulic means, the electromagnetic lifting arrangement 5 is upwardly retracted into its illustrated position, the furnace cover 6 being magnetically raised therewith, as shown in the FIGURE. Thereupon, the non-illustrated hydraulic cylinder-and-piston unit connected to the lifting cable of the filling pipe 7 is deactivated, thereby causing the telescopic filling pipe 7 to descend, until the lower open end thereof is positioned directly over the now-open furnace filling inlet 9. Preheated or moist coal is then fed into the interior of the furnace, through the filling pipe 7 and into the opening 9, from a non-illustrated coal conveying arrangement which discharges into the upper open end of the telescoping filling pipe arrangement 7.

When the filling of the furnace has been completed, the discharging of coal into the filling pipe arrangement 7 is terminated. Thereupon, the non-illustrated hydraulic cylinder-and-piston arrangement connected to the lifting cable of the filling pipe 7 is activated, causing the filling pipe arrangement 7 to telescopically retract upwards, to a position out of the path of downwards movement of the electromagnetic lifting arrangement 5. Thereupon, by hydraulic or other means, the lifting arrangement 5, in energized condition and supporting the furnace cover 6, is caused to descend, until the furnace cover 6 is again in place closing off the furnace filling opening 9. Thereupon, the electromagnetic lifting arrangement 5 is deenergized and upwardly retracted. Advantageously, the interior of the housing 1 is then vented. Finally, the telescoped end section 2 of the arrangement is upwardly retracted, thereby destroying the gas-tight and dust-tight sealing between the upper furnace wall 3 and the interior of the housing 1 of the arrangement.

After this, the illustrated arrangement is shifted to the next one of the filling openings 9 in the battery of furnaces. The translation can be either in sideways direction, as viewed in the FIGURE, or in a direction normal to the plane of the FIGURE. It will be understood that although only a single furnace filling opening 9 is illustrated there is actually provided a plurality of such openings, arranged in a row, and corresponding to the side-by-side arrangement of the furnaces of the battery of furnaces. The arrangement 1, 2, 4–8, 10 can be suspended from a structure which is slidably mounted on rails extending in direction lengthwise of the row of furnace filling openings 9, or can be mounted for shifting movement in other conventional manner.

It will be understood that each of the elements described above, or two or more together, may also find a useful application in other types of constructions differing from the types described above.

While the invention has been illustrated and described as embodied in an arrangement for opening a furnace filling inlet, filling the interior of the furnace and then reclosing the filling inlet, all in a dust-tightly and gas-tightly sealed manner, to prevent the escape of dust and gas into the atmosphere, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In combination with a furnace having a normally closed furnace filling inlet, an arrangement for opening the filling inlet, then filling the interior of the furnace and then reclosing the inlet all in gas-tight and dust-tight manner in order to prevent the free escape of dust and gases during the filling of the furnace, the arrangement comprising a housing having an opening positioned in proximity to the normally closed furnace filling inlet; sealing means activatable for establishing a gas-tight and dust-tight seal between the portion of said housing surrounding said opening and the portion of said furnace surrounding said normally closed furnace filling inlet in order to confine within the interior of said housing any dust and gas entering said filling inlet or escaping from said filling inlet during the filling of the interior of said furnace; means within said housing activatable for opening and reclosing said normally closed furnace filling inlet; and filling means operative for conveying a charge through the interior of said housing and into said furnace filling inlet, said filling means having a discharge end portion located within said housing gas-tightly and dust-tightly connected to said housing so that dust and gas leaving said discharge end portion but not entering said filling inlet are confined within said housing and are unable to freely escape into the ambient atmosphere, wherein the furnace filling inlet is provided with a removable cover, and wherein said means for opening and reclosing said furnace filling inlet comprises a cover-engaging arrangement movable in a first stroke along a first path into engagement with said cover and operative for then engaging said cover and retractable in an opposite second stroke along said first path with said cover engaged, and wherein said filling means comprises a retractable filling pipe arrangement the discharge end portion of which is located within the interior of said housing, said retractable filling pipe arrangement being mounted for movement along a second path between an operative and an operative position, said first and second paths intersecting so that said filling pipe arrangement cannot move into operative position unless said cover-engaging arrangement is in retracted position, and so that said cover-engaging arrangement cannot perform said first stroke unless said filling pipe arrangement is in retracted position.

2. In combination with a furnace having a normally closed furnace filling inlet, an arrangement for opening the filling inlet, then filling the interior of the furnace and then reclosing the inlet all in gas-tight and dust-tight manner in order to prevent the free escape of dust and gases during the filling of the furnace, the arrangement comprising a housing having an opening positioned in proximity to the normally closed furance filling inlet; sealing means activatable for establishing a gas-tight and dust-tight seal between the portion of said housing surrounding said opening and the portion of said furance surrounding said normally closed furance filling inlet in order to confine within the interior of said housing any dust and gas entering said filling inlet or escaping from said filling inlet during the filling of the interior of said furnace; means within said housing activatable for opening and reclosing said normally closed furnace filling inlet; and filling means operative for conveying a charge through the interior of said housing and into said furnace filling inlet, said filling means having a discharge end portion located within said housing gas-tightly and dust-tightly connected to said housing so that dust and gas leaving said discharge end portion but not entering said filling inlet are confined within said housing and are unable to freely escape into the ambient atmosphere, wherein said furnace filling inlet is provided with a removable cover, wherein said sealing means comprises a telescoped housing section movable into and out of engagement with the portion of said furnace surrounding said filling inlet, wherein said means for opening and reclosing said filling inlet comprises electromagnetic lifting means operative for descending to engage said cover and for then lifting said cover by electromagnetic force and for then descending again to replace said cover, and wherein said filling means comprises a telescopically retractable filling pipe arrangement the discharge end portion of which is located within the interior of said housing, wherein said telescopically retractable filling pipe arrangement is mounted for retracting movement in an inclined direction, wherein the discharge end portion of said filling pipe arrangement is of bent configuration having a terminal portion which extends in vertical direction, and wherein said housing is provided with a guide portion defining a guide opening through which said filling pipe arrangement is guided for movement and wherein the peripheral clearance between said filling pipe arrangement and said opening is gas-tightly and dust-tightly sealed.

3. In a combination with a furnace having a normally closed furnace filling inlet, an arrangement for opening the filling inlet, then filling the interior of the furnace and then reclosing the inlet all in gas-tight and dust-tight manner in order to prevent the free escape of dust and gases during the filling of the furnace, the arrangement comprising a housing having an opening positioned in proximity to the normally closed furnace filling inlet; sealing means activatable for establishing a gas-tight and dust-tight seal between the portion of said housing surrounding said opening and the portion of said furnace surrounding said normally closed furnace filling inlet in order to confine within the interior of said housing any dust and gas entering said filling inlet or escaping from said filling inlet during the filling of the interior of said furnace; means within said housing activatable for opening and reclosing said normally closed furnace filling inlet; and filling means operative for conveying a charge through the interior of said housing and into said furnace filling inlet, said filling means having a discharge end portion located within said housing gas-tightly and dust-tightly connected to said housing so that dust and gas leaving said discharge end portion but not entering said filling inlet are confined within said housing and are unable to freely escape into the ambient atmosphere, wherein said furnace filling inlet is provided with a removable cover, wherein said sealing means comprises a telescoped housing section movable into and out of engagement with the portion of said furnace surrounding said filling inlet, wherein said means for opening and reclosing said filling inlet comprises means operative for descending to engage said cover, lifting said cover and then descending again to replace said cover, and wherein said filling means comprises a telescopically retractable filling pipe arrangement the discharge end portion of which is located within the interior of said housing, wherein said telescopically retractable filling pipe arrangement is mounted for retracting movement in an inclined direction, wherein the discharge end portion of said filling pipe arrangement is of bent configuration having a terminal portion which extends in vertical direction, and wherein said housing is provided with a guide portion defining a guide opening through which said filling pipe arrangement is guided for movement and wherein the peripheral clearance between said filling pipe arrangement and said opening is gas-tightly and dust-tightly sealed.

4. The combination defined in claim 3, wherein said sealing means comprises a housing section movable into and out of engagement with the portion of said furnace surrounding said filling inlet.

5. The combination defined in claim 4, wherein said housing section is a telescoped housing section.

6. The combination defined in claim 1, wherein said retractable filling pipe arrangement is comprised of telescoped pipe sections.

7. The combination defined in claim 1, wherein said retractable filling pipe arrangement is mounted for movement through a guide opening in the wall of said housing, and wherein the peripheral clearance between said retractable filling pipe arrangement and said guide opening is gas-tightly and dust-tightly sealed so as not to detract from the confinement of dust and gas within the interior of said housing during the filling of said furnace.

8. The combination defined in claim 7, wherein said housing is provided with an elongated guide pipe forming said guide opening and guiding and filling pipe arrangement for movement.

9. The combination defined in claim 3, and further including a plurality of additional furnaces forming a battery of furnaces having respective filling inlets arranged in a row, and wherein said arrangement is movable along said row.

* * * * *

UNITED STATES PATENT AND TRADEMARK OFFICE

CERTIFICATE OF CORRECTION

PATENT NO. : 3,945,515

DATED : March 23, 1976

INVENTOR(S) : Willi Busbach

It is certified that error appears in the above-identified patent and that said Letters Patent are hereby corrected as shown below:

On the Title page

In the heading, the name and address of the second assignee should be added, and read -- Didier Engineering GmbH, Essen, Germany --.

Signed and Sealed this

*Twenty-first* Day of *September 1982*

[SEAL]

*Attest:*

GERALD J. MOSSINGHOFF

*Attesting Officer*

*Commissioner of Patents and Trademarks*